US008615929B2

(12) United States Patent
Lee et al.

(10) Patent No.: US 8,615,929 B2
(45) Date of Patent: Dec. 31, 2013

(54) DOOR OPENING/CLOSING DEVICE FOR ICE DISPENSER IN REFRIGERATOR

(75) Inventors: Sang Ho Lee, Pyeongtaek-si (KR); Jin Sung Park, Yongin-si (KR); So Yeon Won, Yongin-si (KR); Jin Ho Lee, Suwon-si (KR)

(73) Assignee: SCD, Youngin-si, Gyeonggi-do (KR)

( * ) Notice: Subject to any disclaimer, the term of this patent is extended or adjusted under 35 U.S.C. 154(b) by 366 days.

(21) Appl. No.: 12/839,892

(22) Filed: Jul. 20, 2010

(65) Prior Publication Data

US 2012/0017512 A1 Jan. 26, 2012

(51) Int. Cl.
*E05F 15/02* (2006.01)
*E05F 15/10* (2006.01)

(52) U.S. Cl.
USPC ..... 49/334; 74/89.14

(58) Field of Classification Search
USPC ..... 49/339, 340, 341, 342, 343, 344, 349, 49/358; 74/89.11–89.14, 89.16–89.18
See application file for complete search history.

(56) References Cited

U.S. PATENT DOCUMENTS

| | | | | |
|---|---|---|---|---|
| 5,784,770 | A * | 7/1998 | Long et al. | 29/564.4 |
| 5,828,517 | A * | 10/1998 | Asakura | 360/96.51 |
| 6,007,117 | A * | 12/1999 | Spindler | 292/199 |
| 6,108,975 | A * | 8/2000 | Bailey | 49/334 |
| 6,246,734 | B1 * | 6/2001 | Ohuchi et al. | 375/357 |
| 6,637,347 | B1 * | 10/2003 | Richard et al. | 105/378 |
| 6,694,674 | B2 * | 2/2004 | Son | 49/335 |
| 6,863,318 | B2 * | 3/2005 | Mejean et al. | 292/201 |
| 6,931,649 | B2 * | 8/2005 | Sugita et al. | 720/647 |
| 7,445,137 | B2 * | 11/2008 | Noh et al. | 222/477 |
| 2005/0002714 | A1 * | 1/2005 | Tsuji | 400/59 |
| 2005/0050561 | A1 * | 3/2005 | Hirano et al. | 720/619 |
| 2006/0201194 | A1 * | 9/2006 | Bowen et al. | 62/344 |
| 2009/0000021 | A1 * | 1/2009 | Martin | 4/490 |
| 2009/0119691 | A1 * | 5/2009 | Lee et al. | 720/614 |
| 2012/0017512 | A1 * | 1/2012 | Lee et al. | 49/349 |

FOREIGN PATENT DOCUMENTS

| | | |
|---|---|---|
| KR | 20-2002-0033405 | 11/2002 |
| KR | 20-2004-0012731 | 5/2004 |

* cited by examiner

*Primary Examiner* — Troy Chambers
*Assistant Examiner* — Alexander Vu
(74) *Attorney, Agent, or Firm* — Merchant & Gould P.C.

(57) ABSTRACT

A door opening/closing device for an ice dispenser is disclosed. The door opening/closing device includes a DC motor 1 which is rotated in forward and reverse directions, a 2-staged spur gear 3 meshed with a worm gear 2 installed on a driving shaft, a 3-staged spur gear 4 meshed with the 2-staged spur gear 3, and a fan-shaped output gear 5 meshed with the 3-staged spur gear 4 and rotated in forward and reverse directions by interconnection of the motor 1 and the gears 2, 3 and 4. If the output gear 5 is rotated in the forward direction, a rod-shaped boss 5*a* pushes and rotates a link lever 6*a* to press a coil spring 8 wound around an opening/closing link 6 and thus open a door 7. If the output gear 5 is rotated in the reverse direction, the coil spring 8 is released from a pressurized state, and the rod-shaped boss 5*a* rotates in the reverse direction while abutting against the link lever 6*a*, so that the door 7 is closed without generating impact and sound.

3 Claims, 12 Drawing Sheets

DOOR OPENING/CLOSING DEVICE FOR ICE DISPENSER IN REFRIGERATOR

BACKGROUND OF THE DEVICE

1. Field of the Device

The present device relates to an improved door opening/closing device for an ice dispenser which can dispense a desired amount of ice pieces made by an ice maker of a refrigerator.

Particularly In the present device, ice pieces made in a tray by an ice maker are detached from the tray and are stored in an ice dispenser. In a case of taking out the ice pieces from the ice dispenser, an opening/closing door for the ice dispenser is opened by a push button. In this instance, the opening/closing door of the present device is silently and smoothly opened and closed by an electrical and mechanical rotating means which does not generate shock and impact sound.

2. Description of the Prior Art

In general the door opening/closing device for the ice dispenser is configured to open and close the door for the ice dispenser by electrical operation of a solenoid, thereby dispensing a desired amount of ice pieces, or to open and close the door by using a large-sized cam member eccentrically connected to an output shaft of an AC sync motor, in which a rod connected to the door is rotated around the eccentric cam.

In the case of the configuration which opens and closes the door by electrical operation of the solenoid, an electric current is applied to a copper coil to generate a magnetic field, so that the copper coil becomes an electromagnet to pull or push a movable metal rod. If the power is interrupted, a retracting speed of the metal rod is very quick by a return spring and its one weight of the metal rod. If the retracted metal rod strongly collides against an iron core of a case, significantly strong impact sound is generated, so that a user is startled at the sound of the solenoid. As a result, the strong impact sound whenever the ice is dispensed gives the user an unpleasant feeling and also offends the user.

Further, the solenoid generates strong attracting force in a state in which the case is adhered to the iron core by an attracting principle of the electromagnet. Since initial attracting force is weak at a stage of initial operation in which the metal core is away from the case, there is a problem in that a freezer is covered by frost or is frozen at temperature of −20° C., buzzer sound is generated by continuous vibration until the attracting operation is completely performed at the frozen state.

In the case in which the large-sized eccentric cam member is connected to the output shaft of the AC sync motor to open and close the door, since high-voltage AC power is used, an electric shock is attended with danger at the time of electric leakage in the ice dispenser in which moisture always exists. In addition, since a micro switch for detecting a position of the camp is provided in a separate space, and a minimum rotation radius of the cam is required so as to rotate the cam and operate the switch, the size of the device is necessarily increased. Therefore, the installation of the ice dispenser is hampered by a variety of restrictions in the position and space, and the ice dispenser looks bad externally. Further, it is in a disadvantageous position in view of the cost.

In order to reduce the impact noise and the danger of high-voltage accident, as shown in FIG. 9, a door opening/closing device is disclosed in Korean Unexamined Utility Model Application Publication No. 20-2002-33405, which includes a low-voltage DC motor 31, several reduction gear trains 32 and 33, a rack gear 34, and a movable operator 35, a switch 36 which are installed in a lower case 30 to move in a straight direction. However, the door opening/closing device has drawbacks in that increased number of components causes the configuration to be complex and straight movement of the rack gear 34 and the movable operator 35 restricts the dimension and requires a wide installation space for straight movement. Therefore, the cost for manufacturing and installing the door opening/closing device is increased.

SUMMARY OF THE DEVICE

Accordingly, the present device has been made to solve the above-mentioned problems occurring in the prior art while advantages achieved by the prior art are maintained intact.

One object of the present device is to provide a door opening/closing device for an ice dispenser which can dispense a desired amount of ice pieces made by an ice maker of a refrigerator, in which opening/closing operation of the door for dispensing ice pieces can be silently and smoothly performed.

In order to accomplish the object, there is provided a door opening/closing device for an ice dispenser, the door opening/closing device comprising: a DC motor which is rotated in forward and reverse directions; a 2-staged spur gear meshed with a worm gear installed on a driving shaft; a 3-staged spur gear meshed with the 2-staged spur gear; and a fan-shaped output gear meshed with the 3-staged spur gear and rotated in forward and reverse directions by interconnection of the motor and the gears; wherein if the output gear is rotated in the forward direction, a rod-shaped boss 5*a* pushes and rotates a link lever to press a coil spring wound around an opening/closing link 6 and thus open a door; and if the output gear is rotated in the reverse direction, the coil spring is released from a pressurized state, and the rod-shaped boss rotates in the reverse direction while abutting against the link lever, so that the door is closed without generating impact and sound.

BRIEF DESCRIPTION OF THE DRAWINGS

The above and other objects, features and advantages of the present device will be more apparent from the following detailed description taken in conjunction with the accompanying drawings, in which.

DETAILED DESCRIPTION OF THE PREFERRED EMBODIMENTS

Figure 1:
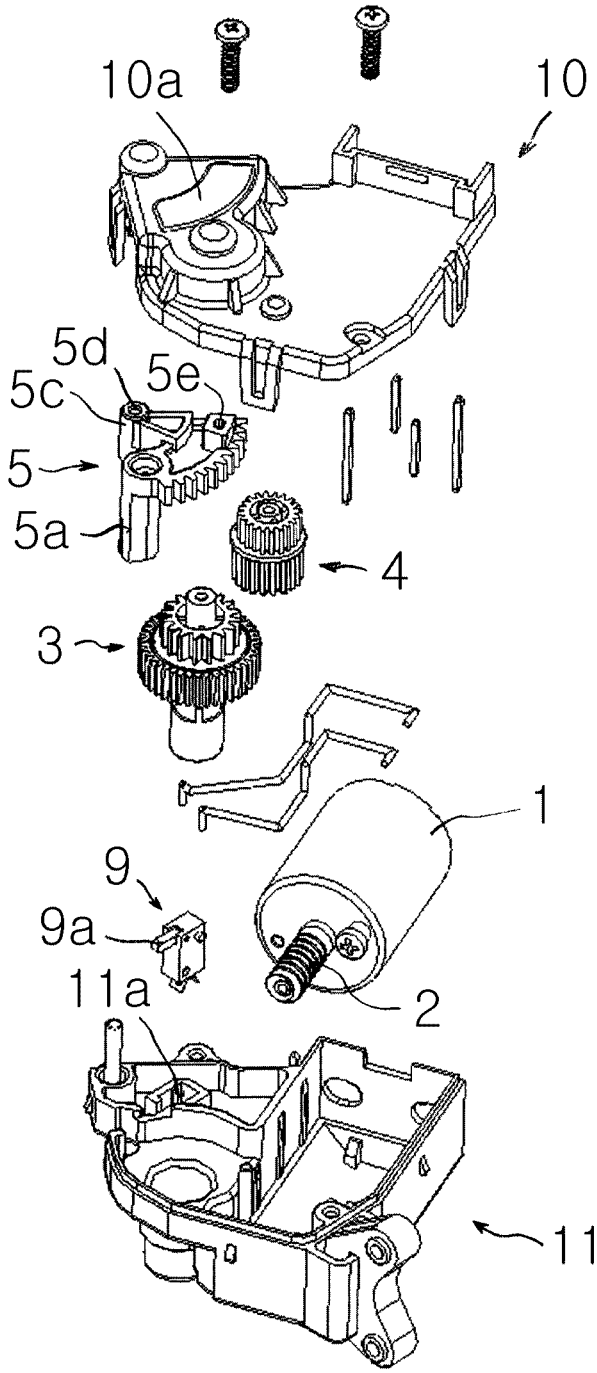
FIG. 1 is an exploded perspective view illustrating major constituent parts of the present device.

Hereinafter, preferred embodiments of the present device will be described with reference to the accompanying drawings. The matters defined in the description, such as the detailed construction and elements, are nothing but specific details provided to assist those of ordinary skill in the art in a comprehensive understanding of the device, and thus the present device is not limited thereto.

A door opening/closing device for an ice dispenser includes a mechanical/electrical operating means for automatically opening and closing a front dispensing door 7 of the ice dispenser. If an ice selection switch is pushed, the operating means is automatically driven by a microcomputer to rotate an opening/closing link 6, and then the front dispensing door 7 mounted on the opening/closing link 6 is opened or closed. The door opening/closing device further includes upper and lower cases 10 and 11 which are detachably engaged to each other, a DC motor 1 which is rotated in forward and reverse directions and mounted in the lower case 11, a 2-staged spur gear 3 meshed with a worm gear 2 installed on a driving shaft, and a 3-staged spur gear 4 meshed with the 2-staged spur gear 3.

Figure 2A:
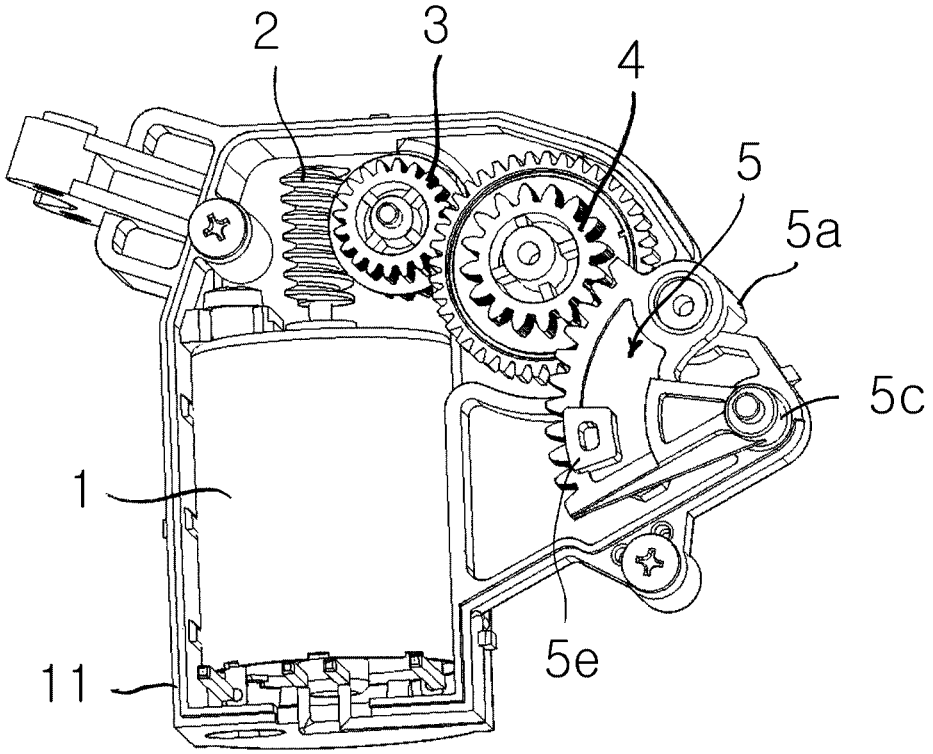
FIG. 2A is a view illustrating an assembled state of a gear according to the present device.
Figure 2B:
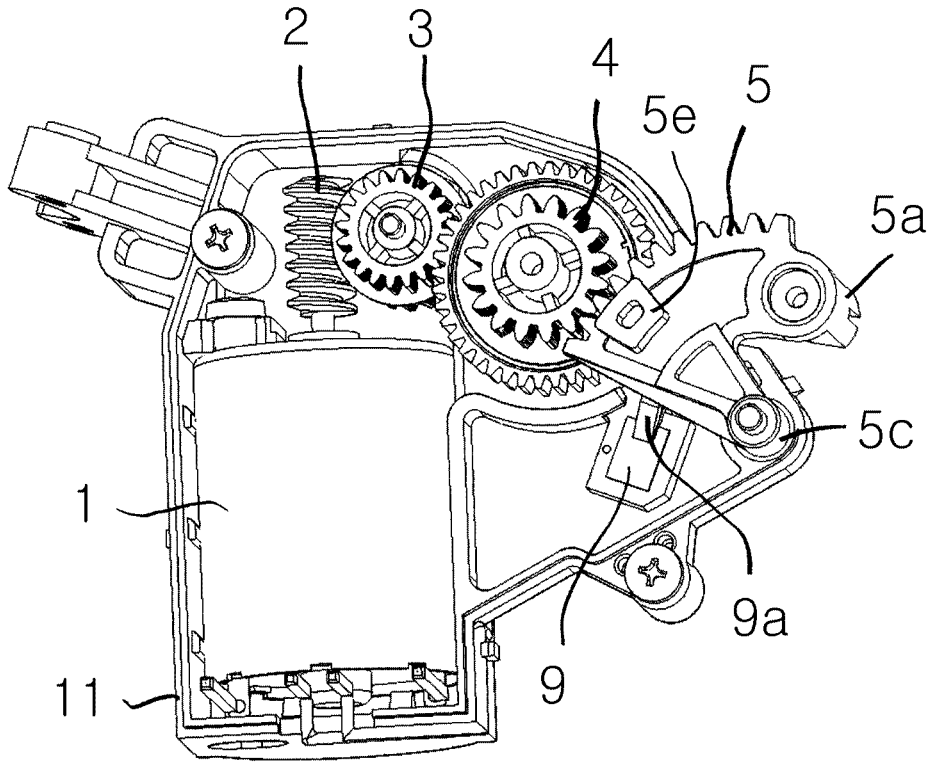
FIG. 2B is a view illustrating an operation state of a gear according to the present device.

As shown in FIG. 1 and FIGS. 2A and 2B, a rotation hole 5*d* of the fan-shaped output gear 5 is inserted in a predetermined position of the upper and lower cases 10 and 11, and the output gear 5 is rotated in forward and reverse directions by interconnection of the motor 1 and the gears 2, 3 and 4. When the output gear 5 is rotated in a forward direction, a rod-shaped boss 5*a* pushes and rotates a link lever 6*a* to press a coil spring 8 wound around an opening/closing link 6 and thus open the door 7. When the output gear 5 is rotated in a reverse direction, the coil spring 8 is released from the pressurized state, and the rod-shaped boss 5*a* abuts against the link lever 6*a*, so that the door 7 is closed without generating impact and sound.

Figure 3A:
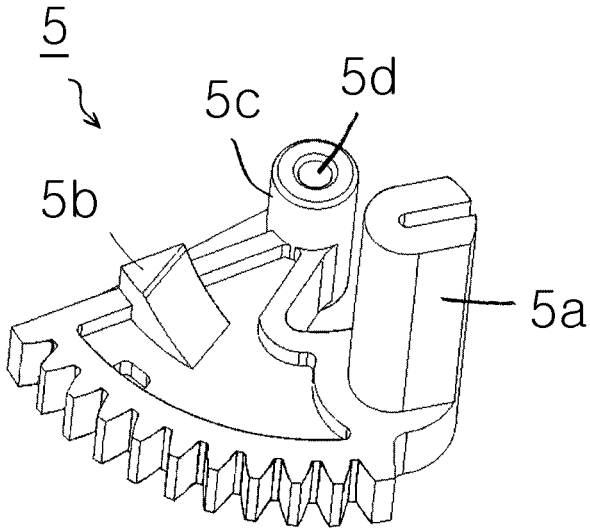
FIG. 3A is a perspective view illustrating a top surface of an output gear according to the present device.
Figure 3B:
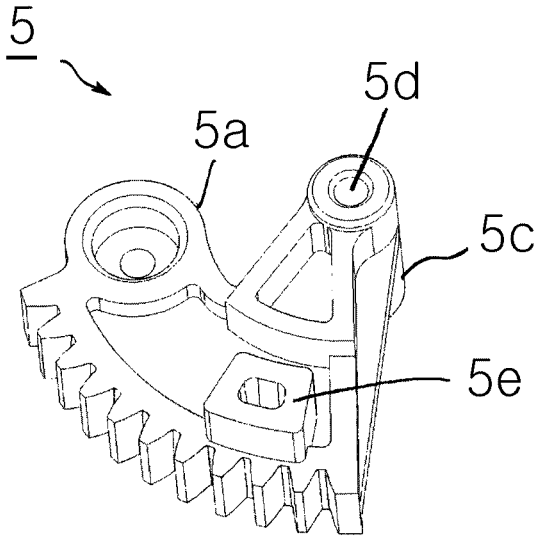
FIG. 3B is a perspective view illustrating a bottom surface of an output gear according to the present device.

The fan-shaped output gear 5 of the device has several functions as one component, as shown in FIGS. 3A and 3B. First, the rod-shaped boss 5*a* and an inclined boss 5*b* protruding upward from the output gear 5 has a function of operating the link lever 6*a* for operating the door, and operating a lever 9*a* of a signal detecting switch 9. Also, a lower trapezoidal boss 5*e* which is inserted in guide grooves 10*a* and 11*a* formed on the upper and lower separated cases 10 and 11 is moved and stopped along guide grooves 10*a* and 11*a*. When the opening/closing link 6 is rotated within a predetermined angle, that is, 50 degrees, which is required to open and close the door, the trapezoidal boss serves as a stopper so that the door is not excessively rotated.

Figure 4A:
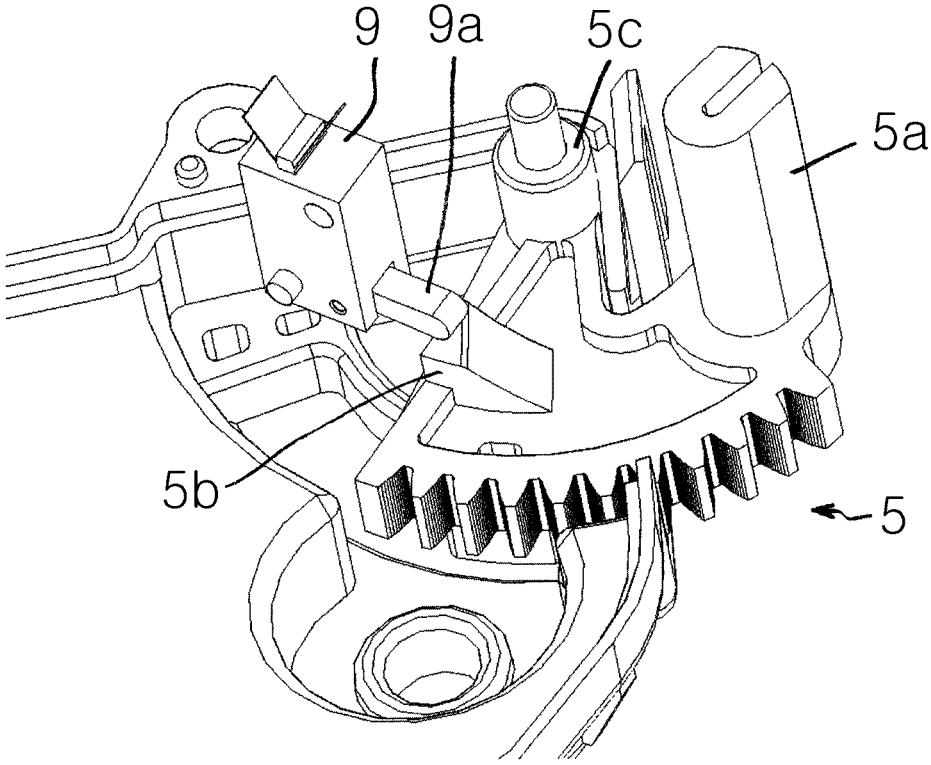
FIG. 4A is a perspective view illustrating a state a switch is turned ON by an output gear according to the present device.
Figure 4B:
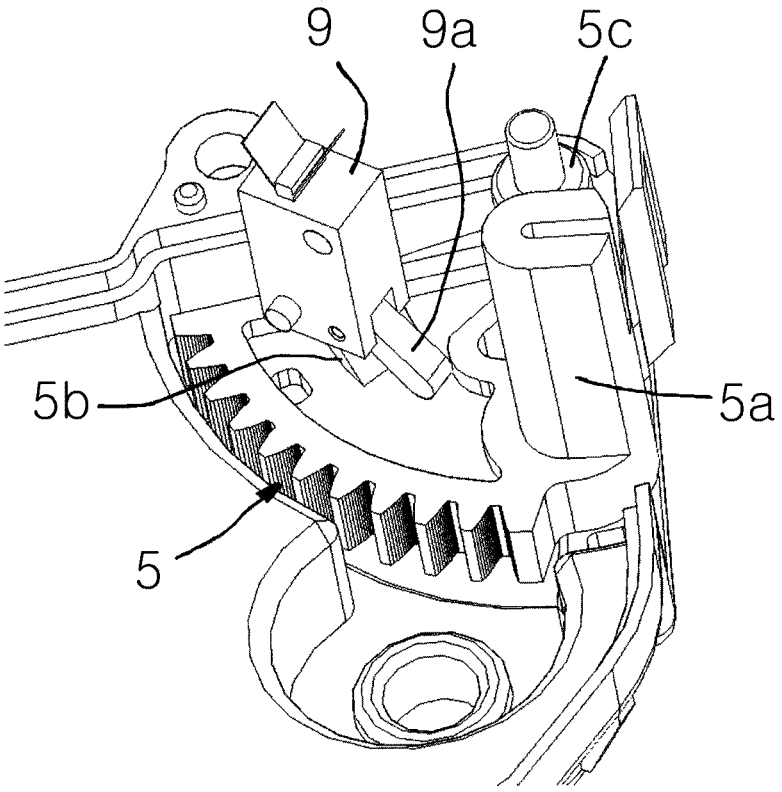
FIG. 4B is a perspective view illustrating a state a switch is turned OFF by an output gear according to the present device.

More specifically, according to the inclined boss 5*b* placed in opposite to the rod-shaped boss 5*a*, when the fan-shaped output gear 5 is rotated, as shown in FIGS. 4A and 4B, the lever 9*a* of the signal detecting switch 9, which is installed on the lower case 11, moves up along an inclined surface of the inclined boss 5*b* to receive a signal. When the fan-shaped output gear 5 is reversely rotated, the lever 9*a* of the signal detecting switch 9 moves down along the inclined surface of the inclined boss 5*b* to send a signal. Therefore, it is possible to detect whether the door of the ice dispenser is opened or closed, based on the signal.

Figure 5A:
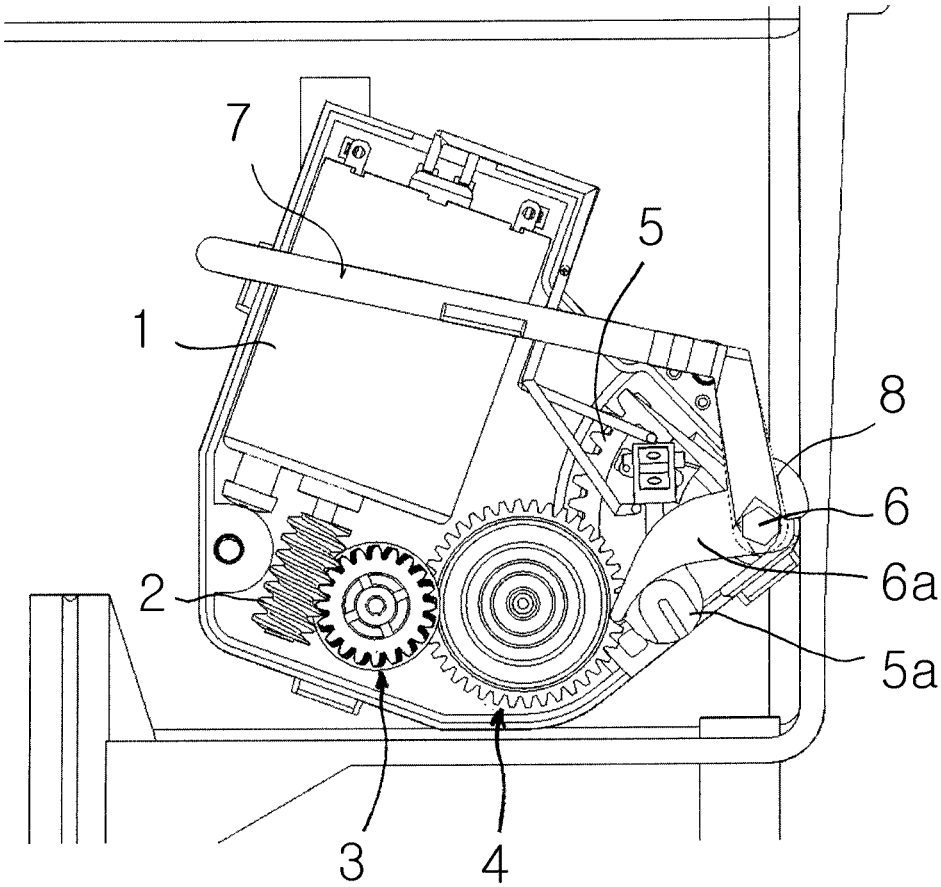
FIG. 5A is a view illustrating a door open state according to the present device.
Figure 5B:
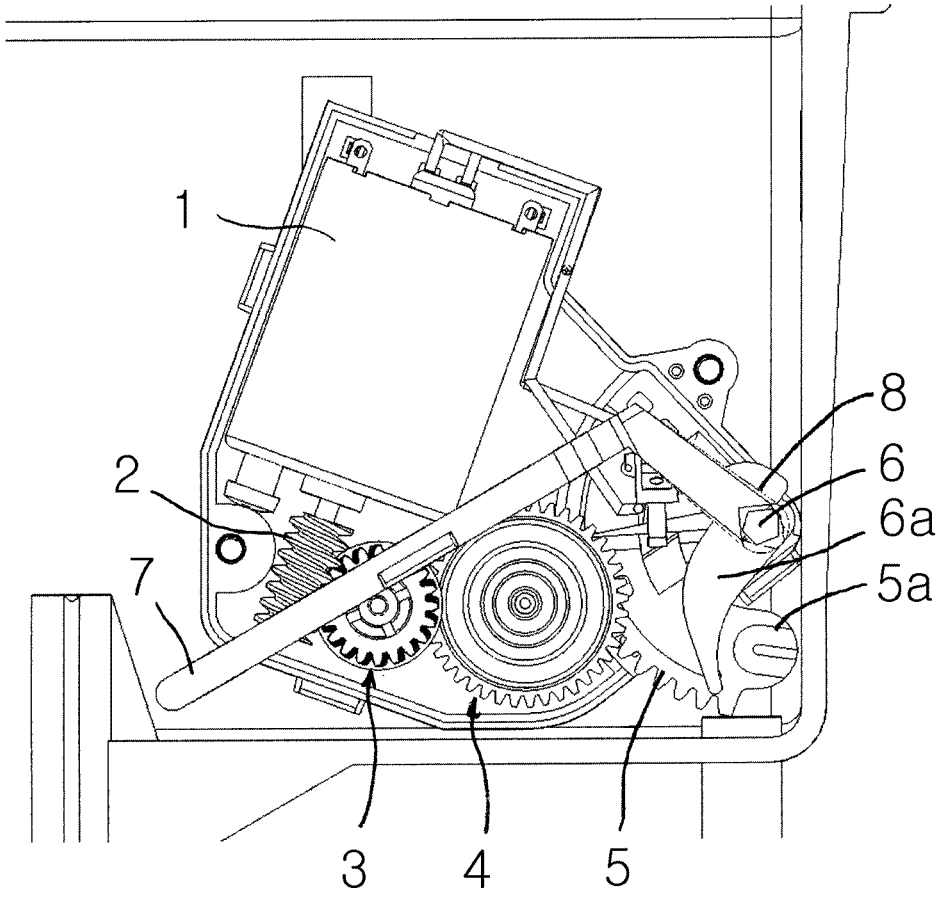
FIG. 5B is a view illustrating a door closed state according to the present device.

As shown in FIGS. 5A and 5B, the rod-shaped boss 5*a* is placed in the link lever 6*a* of the opening/closing link 6, and a returning member of the coil spring 8 is built in the opening/closing link 6. At normal times, the door 7 is closed by a magnetic force of the coil spring 8 wound around the opening/closing link 6. If the user operates the dispensing button, the output gear 5 is rotated in a forward direction by the microcomputer. In this instance, while the rod-shaped boss 5*a* abuts against the link lever 6*a*, the rod-shaped boss 5*a* strongly pushes the link lever 6*a* with force larger than a resilient force of the spring 8 by rotation of the output gear 5. As a result, the opening/closing link 6 is rotated to perform the opening of the door 7, thereby maintaining the open state, as shown in FIG. 5A.

If the ice dispensing operation is completed while the door 7 is opened, the output gear 5 is rotated in a reverse direction to the close position. In this instance, the link lever 6*a* is automatically rotated in a reverse direction by a resiliently returning force of the coil spring 8. Simultaneously, the opening/closing link 6 is rotated in a reverse direction to close the door 7, thereby maintaining the closed state, as shown in FIG. 5B.

In the closed state, because the link lever 6*a* is not engaged to the output gear 5 and is closed by the returning resilient force of the coil spring 8, if the user manually opens the door 7, the door can be easily opened without generating a restriction force or a catching phenomenon. If the user gets the open door 7 off his or her hand, the door 7 is returned to an original position, that is, the closed state, by the returning force of the coil spring 8.

In this embodiment, the fan-shaped output gear 5 is directly assembled to the upper and lower cases 10 and 11, but it is preferable that a stainless shaft is inserted into the rotation shaft 5*c* to reinforce the strength of the rotation support shaft.

The reason is that the fan-shaped output gear 5 pushes the ring-shaped link lever 6*a*, and thus is applied with significant force and torque. In order to withstand the load, the rotation shaft 5*c* has to have a large outer diameter.

Figure 6:
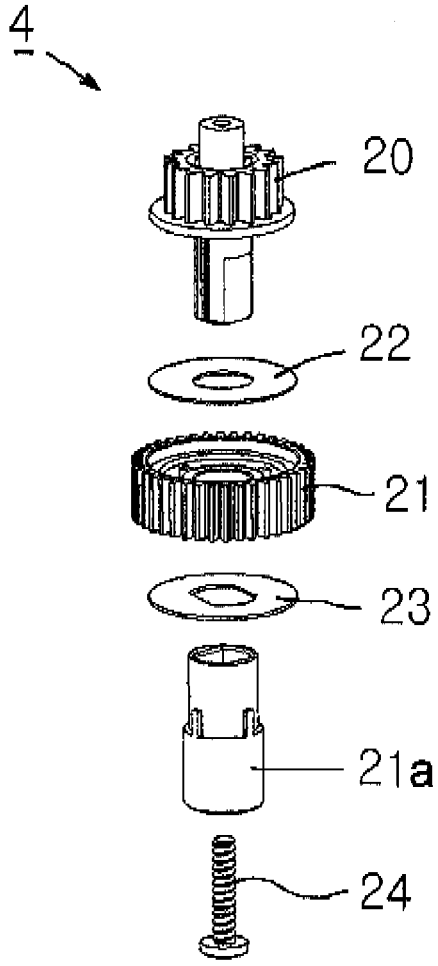
FIG. 6 is an exploded perspective view illustrating a 3-staged spur gear according to the present device.

However, since the rotation shaft 5*c* having large outer diameter is not formed in the narrow space in the ice dispenser, the separate stainless shaft is inserted into the rotation shaft 5*c* to reinforce the rotation shaft, thereby withstanding the significant force and torque. The 3-staged spur gear 4 is adapted to prevent the constituent components from being damaged due to abnormal excessive load which may be generated when the user pulls the dispenser door 7 to open the door, as shown in FIG. 6.

More specifically, a stainless washer 22 is mounted between the pinion gear 20 and the gear 21, and a stainless washer 23 is mounted between the gear 21 and a lower fixing rod 21*a*, and assembled with screws 24, thereby preventing excessive rotation load from being generated due to slip rotation of the stainless washers 22 and 23 when excessive rotation force is generated.

Figure 7:
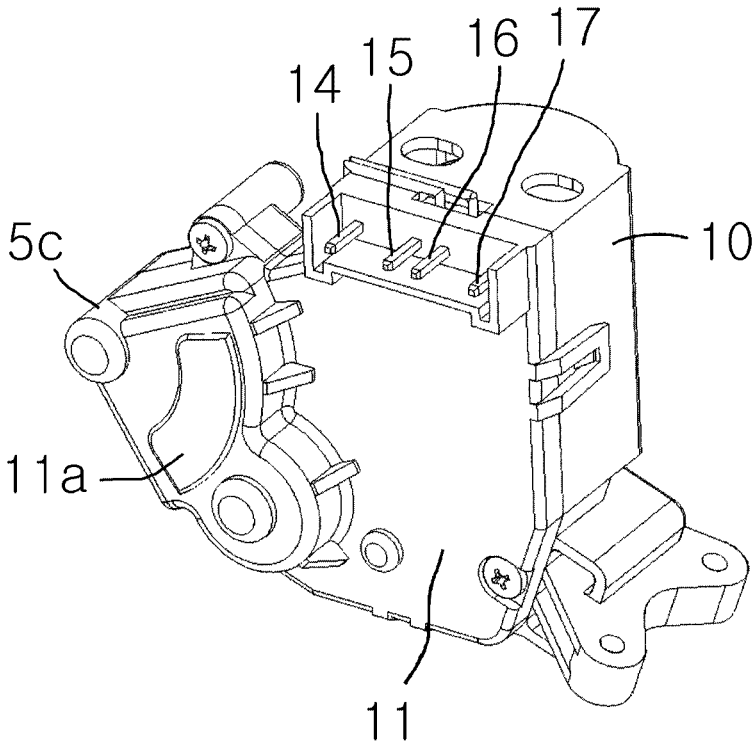
FIG. 7 is a perspective view illustrating an arrangement state of a power input terminal according to the present device.
Figure 8:
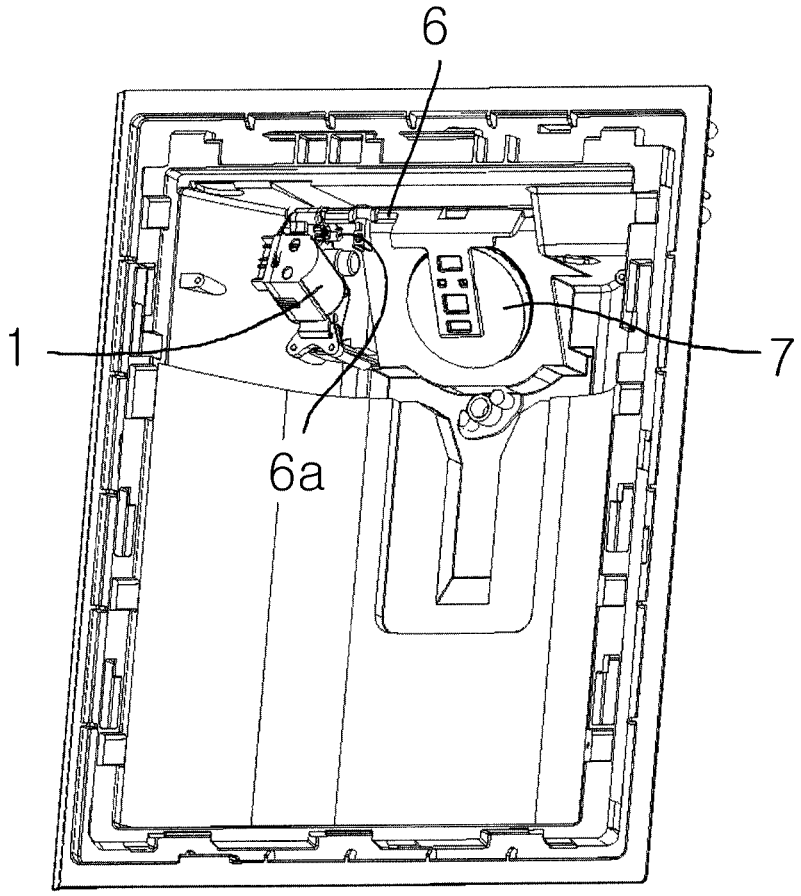
FIG. 8 is a view illustrating an ice dispenser mounted with a door opening/closing device according to the present device.
Figure 9:
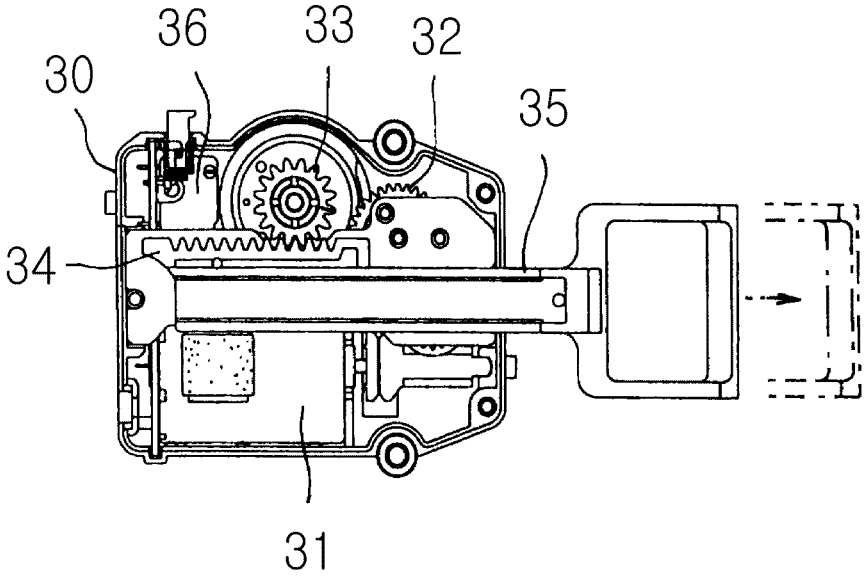
FIG. 9 is a view illustrating a door opening/closing device of a straight movement type using a rack gear according to a related art.

As shown in FIG. 7, the power input terminals 14, 15, 16 and 17 and the signal detecting power cable are integrally constituted by using an electric cable in the lower case 11, and are arranged in parallel with each other. Four CP wires are arranged in parallel with each other in the case, and the case has an exterior appearance corresponding to the shape of an opposite case.

Two CP wires are connected to a power supply of the motor 1 to supply a power, and the other two CP wires are connected to the signal detecting switch 0 via an electric cable to detect the signal.

In past, the power input of the motor 1 and the signal detecting portion of the signal detecting switch 9 are placed apart from each other, so that it is required to connect each other via two or more opposite housing and a connection wire. However, in the present device, the CP wires are forcibly pressed in a shape similar to the housing of the lower case 11, and the power input terminals 14, 15, 16 and 17 and the signal detecting power cable are integrally constituted by using the electric cable and are arranged in parallel with each other, thereby assembling them as one housing. As a result, it is possible to reduce the cost, improve the assembly ability, and shorten a working time.

In the present device, the rotation shaft 5*c* of the fan-shaped output gear 5 is designed to have 50 degrees as an opening/closing angle of the dispensing door 7, thereby pushing the link lever 6*a* of the opening/closing link 6 in the same phase difference on the same axis to open the door 7. The distance between the center of the fan-shaped output gear 5 and the center of the rod-shaped boss 5*a* is 12.5 mm, so that the force required to pull the link lever 6*a*, the opening/closing link 6 and the door 7 is sufficiently generated. It is designed to prevent it from interfering with other parts such as opening/closing link 6 and the upper and lower cases 10 and 11.

As described above, instead of the conventional solenoid used as an electrically movable operating means for opening and closing the door for the ice dispenser, the DC motor, the spur gear and the fan-shaped output gear are assembled to form the electrically rotating means, thereby preventing the impact sound or buzzer sound at the time of arc reciprocation. The opening/closing operation of the door for dispensing ice pieces is silently and smoothly performed. Further, it is safe from an electric shock due to high voltage, and the number of the components is significantly reduced as compared with a conventional device using the AC motor to achieve high cost reduction. In addition, the device is configured to have a compact size due to the downsized volume. As a result, it is possible to create a beautiful appearance and maximize a space use of the refrigerator. More over, since ice dispensing operation is comfortable at the time of dispensing the ice pieces, there is no discomfort in the use or it does not scare the user.

Although preferred embodiments of the present device have been described for illustrative purposes, those skilled in the art will appreciate that various modifications, additions and substitutions are possible, without departing from the scope and spirit of the device as disclosed in the accompanying claims.

What is claimed is:

1. A door opening/closing device for an ice dispenser, the door opening/closing device comprising:

a DC motor which is rotatable in forward and reverse directions;

a 2-staged spur gear meshed with a worm gear installed on a driving shaft;

a 3-staged spur gear meshed with the 2-staged spur gear;

a fan-shaped output gear meshed with the 3-staged spur gear and rotated in forward and reverse directions by interconnection of the motor and the 2-staged spur gear, worm gear and 3-staged spur gear;

the fan-shaped output gear includes a rod-shaped boss and an inclined boss protruding upward from the output gear, and a trapezoidal boss protruding downward from the output gear, in which the inclined boss is placed in opposite to the rod-shaped boss, wherein if the output gear is rotated in the forward direction, a rod-shaped boss pushes and rotates a link lever to press a coil spring wound around an opening/closing link and thus open a door; and if the output gear is rotated in the reverse direction, the coil spring is released from a pressurized state, and the rod-shaped boss rotates in the reverse direction while abutting against the link lever, so that the door is closed without generating impact and sound, wherein the 3-staged sped spur gear comprises a pinion gear, a gear and a lower fixing rode, the 3-staged sped spur gear further comprising a washer mounted between, and in contact with, the pinion gear and the gear, and a washer mounted between the gear and the lower fixing rod, thereby preventing excessive rotation load from being generated due to slip rotation of the washers; and upper and lower cases including the DC motor, the worm gear, the 2-staged spur gear, the 3-staged spur gear and the opening/closing link, wherein the lower case formed in a housing shape and forcibly mounted with a CP wire, and first, second, third and fourth power input terminals and a signal detecting power cable which are integrally constituted by using an electric cable, and are arranged in parallel with each other, wherein the four input terminals are arranged in parallel with each other in the case, and the case has an exterior appearance corresponding to a shape of an opposite case, and the first and second inputer terminals are connected to a power supply of the motor to supply a power, and the third and fourth input terminals are connected to the signal detecting switch via an electric cable to detect the signal.

2. The door opening/closing device of claim 1, wherein the trapezoidal boss 5*e* is adapted to be disposed in a guide groove defined in a housing enclosing the output gear.

3. The door opening/closing device of claim 1, wherein the inclined boss 5*b* is adapted to be engaged to a switch and to actuate the switch when the output gear is rotated.

* * * * *